United States Patent [19]

Tüns

[11] 4,364,478

[45] Dec. 21, 1982

[54] MANUFACTURE OF EASILY OPENABLE FOIL BAG

[75] Inventor: Heinz-Joseph Tüns, Dachsen, Switzerland

[73] Assignee: SIG - Schweizerische Industrie-Gesellschaft, Neuhausen am Rheinfall, Switzerland

[21] Appl. No.: 241,066

[22] Filed: Mar. 6, 1981

[30] Foreign Application Priority Data

Mar. 14, 1980 [CH] Switzerland ..... 2055/80

[51] Int. Cl.[3] ..... B65D 3/26

[52] U.S. Cl. ..... 206/605; 206/629; 53/412; 493/212; 493/930

[58] Field of Search ..... 229/87 C; 206/604, 605, 206/628, 629; 53/412, 479; 493/212, 930

[56] References Cited

U.S. PATENT DOCUMENTS

| | | | |
|---|---|---|---|
| 1,640,685 | 8/1927 | Aitelli | 206/605 |
| 2,249,392 | 7/1941 | Moore | 229/87 C X |
| 2,333,887 | 11/1943 | Redlinger | 53/412 X |
| 2,353,746 | 7/1944 | Moore | 53/412 X |
| 2,360,597 | 10/1944 | Topolski | 206/628 X |
| 3,291,377 | 12/1966 | Eggen | 206/605 X |
| 3,795,080 | 3/1974 | Smolderen et al. | 53/412 |
| 4,027,455 | 6/1977 | Rausing et al. | 53/412 |

FOREIGN PATENT DOCUMENTS

| | | | |
|---|---|---|---|
| 1182656 | 1/1959 | France | 206/604 |

*Primary Examiner*—William Price
*Assistant Examiner*—Gary E. Elkins
*Attorney, Agent, or Firm*—Spencer & Kaye

[57] ABSTRACT

In a foil bag composed of a foil piece and a tearing strip means, the bag having a flattened head portion, a longitudinal seam extending across the head portion, and a transverse seam transverse to, and crossing, the longitudinal seam in the head portion and sealing the bag, the tearing strip being spaced from the transverse seam in the direction toward the interior of the bag, and serving to aid opening by permitting a wall of the head portion which is not traversed by the longitudinal seam and which extends approximately across the width of the head portion to be torn open, and the tearing strip being provided with a gripping part projecting from the bag, the bag is provided with cuts defining a U-shaped passage opening, the gripping part extends through the opening from the interior of the bag to the exterior of the bag, and the bag is further provided with a seam parallel to the transverse seam and at the opposite side of the opening from the transverse seam, and a sealing seam intersecting the transverse seam and at least in part covering the transverse seam and the seam parallel to the transverse seam to form therewith a gastight seal around the passage opening.

10 Claims, 10 Drawing Figures

MANUFACTURE OF EASILY OPENABLE FOIL BAG

BACKGROUND OF THE INVENTION

The present invention relates to a foil bag of the type provided with tearing means which serve as an opening aid, and a method for its manufacture.

Such opening aids are known. For example, U.S. Pat. No. 2,353,746 describes a foil bag having a flattened head portion in which a tear string is embedded. The string extends along the inside of the bag and is disposed within the head portion next to a transverse seam. One end of the string is brought to the outside through this transverse seam. To open the bag, the bag must first be torn transversely to the transverse seam and then alongside the seam. If the procedure followed is different in any respect, the bag may be impossible to open under certain circumstances.

German Offenlegungsschrift [Laid-open Application] No. 2,813,598 discloses an opening aid of the above-mentioned type in which one wall of the bag is provided with two openings in the form of straight cuts which are spaced from the respective lateral limits of the head portion and through which the tearing means is inserted and thus forms two gripping pieces. The contacting walls of the head portion are sealed around the cuts. Thus the inserted band undergoes an abrupt change in direction at the cuts. In the region of these cuts, the wrapping material forms waves and folds so that a gas-tight seal can be attained only with difficulty.

Swiss Pat. No. 595,983 describes a foil bag with a tear strip whose gripping end is made accessible in that the wrapping material is provided with a U-shaped cut around the gripping end. The arms of the cut are bent over when the longitudinal edges of the head portion are formed so that the gripping end and the cut-out flap spread open upon folding and project beyond the edge. This requires a selection from a limited number of available materials, so that such bags can be manufactured only for limited use.

SUMMARY OF THE INVENTION

It is an object of the present invention to provide an opening aid for foil bags which assures reliable handling during manufacture as well as during use.

A further object of the invention is to facilitate evacuation and hermetic sealing of the bag in an economical manner while making it possible for the gripping end of the tearing means to not be sealed to the part of the foil disposed below it.

The above and other objects are achieved, according to the invention, in a foil bag composed of a foil piece and tearing means, the bag having a flattened head portion having two walls, a longitudinal seam extending across the head portion, and a transverse seam which secures the two walls of the head portion to each other, the transverse seam being transverse to, and crossing, the longitudinal seam in the head portion and sealing the bag, the tearing means being spaced from the transverse seam in the direction toward the interior of the bag, and serving to aid opening by permitting a wall of the head portion which is not traversed by the longitudinal seam and which extends approximately across the width of the head portion to be torn open, and the tearing means being in the form of a strip provided with a gripping part projecting from the bag, in that: the bag is provided with a U-shaped passage opening composed of two cuts parallel to, and one cut perpendicular to, the transverse seam in the head portion; the gripping part extends through the opening from the interior of the bag to the exterior of the bag; and the bag is further provided with a seam parallel to the transverse seam and at the opposite side of the opening from the transverse seam, and a sealing seam intersecting the transverse seam and at least in part covering the transverse seam and the seam parallel to the transverse seam to form therewith a gas-tight seal around the passage opening.

The objects according to the invention are further achieved by a method for producing the foil bag defined above, by the steps of:

supplying a band-shaped packaging foil in an advancing direction; cutting the U-shaped passage opening in the foil at a location spaced from the leading edge, in a manner such that the legs of the U are transverse to the advancing direction and the opening thus presents a flap delimited by the cuts composing the opening; supplying a narrow band of tear-resistant material and attaching that band to the foil at the side thereof which defines the interior surface of the bag and at a distance from the leading edge of the foil corresponding to the location of the passage opening, the band of material extending across the passage opening and being fastened to the foil in a region located to one side of the passage opening and being not fastened to the foil in the region of the passage opening and in the region located to the other side thereof; cutting the band to a desired length so that the cut portion constitutes the tearing strip, and pushing the part of the strip covering the region located at the other side of the passage opening through said passage opening to the opposite side of the foil; cutting a piece from the foil, forming said piece into the bag, which is open at its head portion, and filling the bag via the head portion thereof; and closing the head portion and hermetically sealing the interior of the bag by forming folded edges at opposite sides thereof, forming the seams to seal the head portion, folding the head portion down against an adjacent portion of the foil piece, and folding the folded edges in.

DESCRIPTION OF THE PREFERRED EMBODIMENTS

Figure 1:
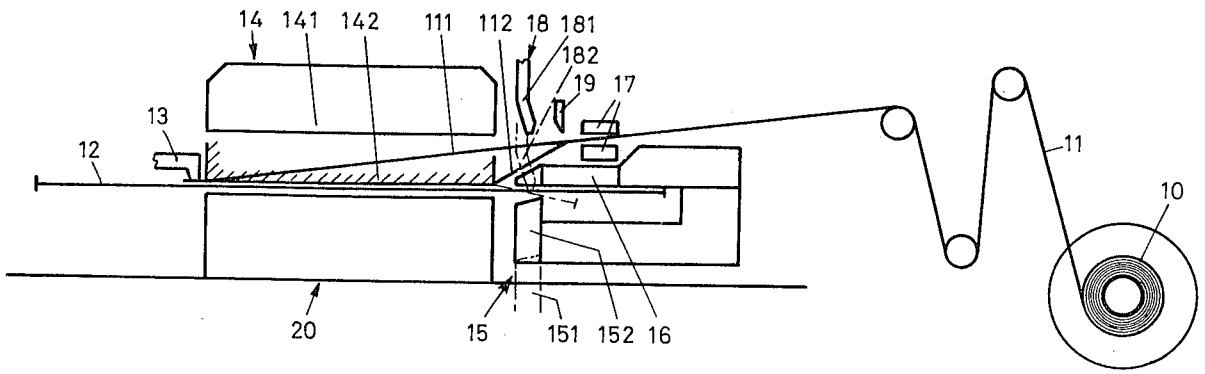
FIG. 1 is a simplified schematic elevational view of part of a packaging machine for inserting a tear strip in accordance with the invention.

FIG. 1 shows several parts of the packaging machine in their rest positions and in part in operating positions for assembling a tear strip 11, which is furnished from a supply, e.g. a reel, 10, with a band-shaped packaging foil 12. A transporting gripper 17 which is displaceable from the right to the left in the drawing, advances the tear strip 11 and the leading end of the tear strip 11 is held in place by means of a holding finger 13 which may be a suction-type device. The packaging foil 12 is cut by means of a U-shaped blade 15, which can be moved from a rest position 151 to a working position 152, and a cooperating matrix 16, so that the cross-piece, or base, of the U is oriented toward the reel 10 and the opening of the U between its two legs faces away from the reel 10.

By means of a heated pressing bar 14 and a counterbar 20, the pressing bar 14 being movable from an upper position 141 to a lower position 142, the tear strip 11 is fastened to the side of the packaging foil 12 which faces upwardly. During this operation, the strip 11 is moved from an upper position 111 into a lower position 112. Now the tear strip can be severed by the action of a heated severing blade 19 and can be pushed, by means of a pusher 18, which can likewise be moved between an upper position 181 and a lower position 182, through the U-shaped passage opening formed previously in the packaging foil 12 to bring the respective end of the tear strip into the position shown by the dashed line.

Successive stages in the manufacture of a piece for the formation of a foil bag of the type described above are shown in FIGS. 2A through 2E. These Figures depict an arrangement in which the packaging foil of FIG. 1 would have been introduced into the described arrangement from the side facing the viewer so that the packaging machine, of a known design, would have to be arranged behind the plane of the drawing.

Figure 2A:
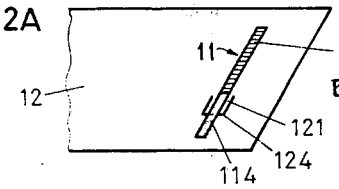
FIGS. 2A, C and E are elevational perspective views and FIGS. 2B and D are cross-sectional views showing three different stages in the insertion of a tear strip using the apparatus of FIG. 1.
Figure 2B:
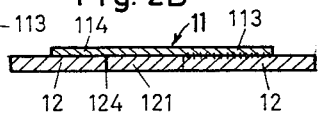
Figure 2C:
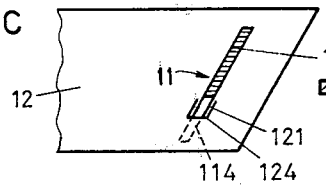
Figure 2D:
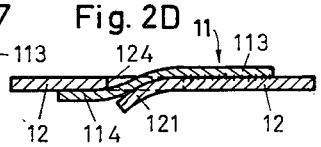
Figure 2E:
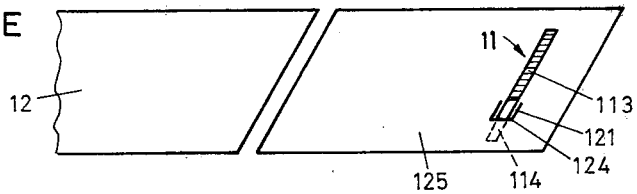

FIG. 2A shows the cut-off tear strip 11 on the packaging foil 12, with the hatched part 113 of the strip fastened to the foil and the unhatched part 114 simply resting on the foil and extending past the passage opening 124 which is closed by means of a flap 121. FIG. 2B shows the same arrangement in cross section. Here the barshaped cut 124 can be seen clearly. FIG. 2C shows the unfastened portion 114 of the tear strip 11 having been pushed through to the underside of the packaging foil 12. The pusher, or sword, 18 of FIG. 1 was used to push the free end 114 of the tear strip 11 from the top through the passage opening 124 of the packaging foil 12, the end 114 taking on the position shown in FIG. 2D due to the stiffness of the tear strip. FIG. 2E shows the piece 125 cut to form a bag package blank and, to the left thereof, the following portion of the band-shaped packaging foil 12.

Figure 3:
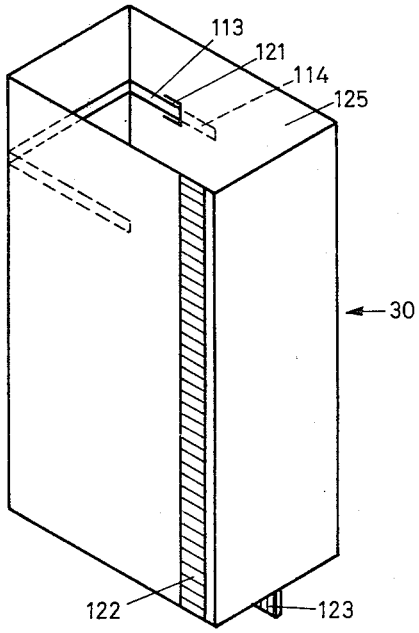
FIGS. 3, 4 and 5 are perspective views showing successive stages of the manufacture of a bag according to an embodiment of the invention.

This piece 125 is used to form, in a known manner, a foil bag 30, as shown in a partly formed state in FIG. 3, which has a longitudinal seam 122 and a lower transverse seam 123. As can be seen here very clearly, the tear strip 113 is not disposed in the area of the longitudinal seam 122 and the free end 114 of the tear strip is disposed on the outside near the top of the bag at a point diametrically opposite the longitudinal seam.

Figure 4:
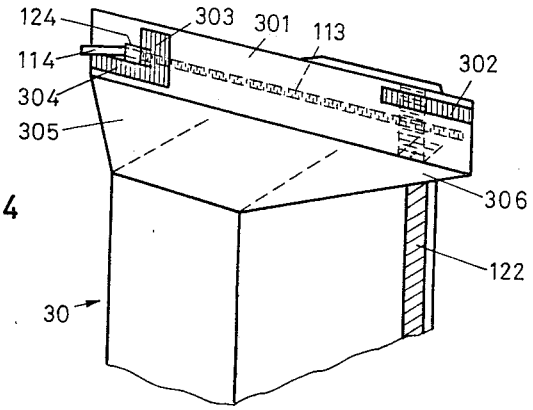
Figure 5:
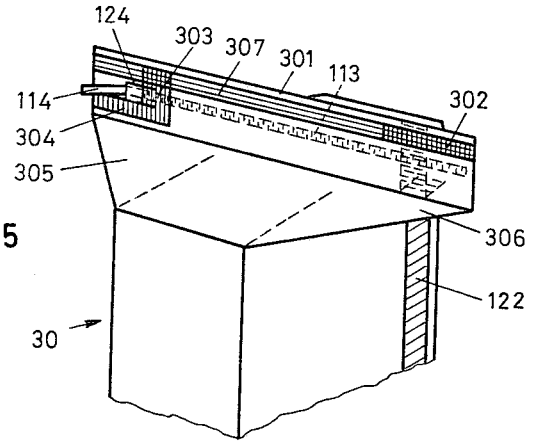

FIGS. 4 and 5 show only the upper portion of the foil bag 30 in a position rotated counterclockwise by 90° from that of FIG. 3. Thus the longitudinal seam 122 is in the wall of the bag shown on the right. The head portion 301 and the two side flaps 305 and 306 have likewise been formed in a known manner. The tear strip extends over a major portion of the longitudinal extent of the head portion 301. The free portion 114 of the tear strip projects from the passage opening 124. A first preliminary seal 302 is formed at the end of the head portion 301 opposite the passage opening 124. This seal extends parallel to the tear strip and is located between the tear strip and the upper edge of the head portion 301 so as to seal the right-hand part of the head portion from the outside.

A second preliminary seal 303 has been formed behind the passage opening 124 transversely across the tear strip 113, while a third preliminary seal 304 seals the head portion 301 from the outside on the left below the passage opening 124. These three preliminary seals delimit an access to the interior of the bag in the center portion of the head portion 301 through which the bag can be evacuated.

Finally, as shown in FIG. 5, a transverse seam 307 is made above the tear strip. This transverse seam 307 is coextensive with the length of head portion 301 and covers the first preliminary seal 302 and an upper portion of the second preliminary seal 303. Thus the bag is sealed in a gastight manner.

Figure 6:
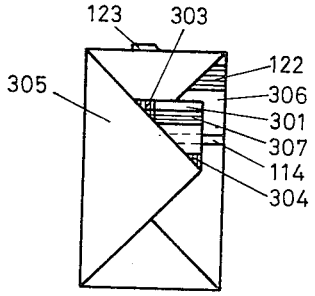
FIG. 6 is an elevational end view of the bag of FIGS. 3–5 in its finished state.

FIG. 6 is a top view of the upper end of the bag package in its finished, or fully closed, state in which the head portion 301 has been folded flat against the package top and the side flaps 305 and 306 have been folded in, also against the package top. The longitudinal seam 122, the transverse seam 307, the second preliminary seal 303 and the third preliminary seal 304 can be seen very clearly, as can the tear strip located between seal 304 and transverse seam 307, together with the free end 114 of the tear strip which serves as the end which is gripped by the user to effect opening of the package.

It will be understood that the above description of the present invention is susceptible to various modifications, changes and adaptations, and the same are intended to be comprehended within the meaning and range of equivalents of the appended claims.

What is claimed is:

1. In a foil bag composed of a foil piece and tearing means, the bag having a flattened head portion having two walls, a longitudinal seam extending across one of said walls of the head portion, and a transverse seam which secures the two walls of said head portion to each other, said transverse seam being transverse to, and crossing, the longitudinal seam in the head portion and sealing the bag, the tearing means being spaced from the transverse seam in the direction toward the interior of the bag, and serving to aid opening by permitting a wall of the head portion which is not traversed by the longitudinal seam and which extends approximately across the width of the head portion to be torn open, and the tearing means being in the form of a strip provided with a gripping part projecting from the bag, the improvement wherein: said bag is provided with a U-shaped passage opening composed of two cuts parallel to, and one cut perpendicular to, said transverse seam in the head portion; said gripping part extends through said opening from the interior of said bag to the exterior of said bag; and said bag is further provided with a seam parallel to said transverse seam and at the opposite side of said opening from said transverse seam, and a sealing seam intersecting said transverse seam and at least in part covering said transverse seam and said seam parallel to said transverse seam to form therewith a gastight seal around said passage opening.

2. An article as defined in claim 1 wherein said passage opening is defined by cuts in the foil piece in an area which is not traversed by folded edges of said bag.

3. An article as defined in claim 2 wherein said seam parallel to said transverse seam is disposed immediately adjacent a cut defining said passage opening extending on the side of said opening directed toward the interior of said bag and parallel to said transverse seam.

4. An article as defined in claim 3 wherein said passage opening is defined by three cuts forming a flap, with two of the cuts being parallel to one another, and said sealing seam traverses said flap and said two parallel cuts.

5. An article as defined in claim 4 wherein said gripping part projects beyond said flap.

6. An article as defined in claim 5 wherein said gripping part has a projecting length at least as long as said flap.

7. An article as defined in claim 6 wherein said head portion is laterally delimited by folded edges, the free end of said gripping part projects beyond one folded edge and extends no further than an associated edge of the bag bordering the head portion, and said head portion is flattened and folded down.

8. An article as defined in claim 1 wherein all seams of said bag are made in an airtight manner so that a subatmospheric pressure can be maintained in the interior of said bag.

9. Method for producing the foil bag defined in claim 1, in a packaging machine, comprising:

supplying a band-shaped packaging foil in an advancing direction;

cutting said U-shaped passage opening in the foil at a location spaced from the leading edge, in a manner such that the legs of the U are transverse to the advancing direction and the opening thus presents a flap delimited by the cuts composing the opening;

supplying a narrow band of tear-resistant material and attaching that band to the foil at the side thereof which defines the interior surface of said bag and at a distance from the leading edge of the foil corresponding to the location of the passage opening, said band of material extending across said passage opening and being fastened to said foil in a region located to one side of said passage opening and being not fastened to said foil in the region of said passage opening and in the region located to the other side thereof;

cutting said band to a desired length so that the cut portion constitutes said tearing strip, and pushing the part of said strip covering the region located at said other side of said passage opening through said passage opening to the opposite side of said foil;

cutting a piece from said foil, forming said piece into said bag, which is open at its head portion, and filling said bag via said head portion thereof; and closing said head portion and hermetically sealing the interior of said bag by forming folded edges at opposite sides thereof, forming said seams to seal said head portion, folding said head portion down against an adjacent portion of foil piece, and folding said folded edges in.

10. Method as defined in claim 9 comprising before sealing the interior of said bag by means of said transverse seam, forming a seal at the side of said head portion opposite said passage opening to form a passage via which the interior of said bag can be evacuated.

* * * * *